US007195547B2

(12) United States Patent
Chen

(10) Patent No.: US 7,195,547 B2
(45) Date of Patent: Mar. 27, 2007

(54) DUAL PLATE SANDER

(75) Inventor: Chengzhong Chen, Suzhou (CN)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 11/437,145

(22) Filed: May 19, 2006

(65) Prior Publication Data

US 2006/0270327 A1 Nov. 30, 2006

(30) Foreign Application Priority Data

May 20, 2005 (CN) ..... 2005 2 0108419

(51) Int. Cl.
*B24B 23/00* (2006.01)

(52) U.S. Cl. ..... 451/164; 451/356

(58) Field of Classification Search ..... 451/162, 451/164, 344, 356; 73/59, 169; 74/42
See application file for complete search history.

(56) References Cited

U.S. PATENT DOCUMENTS

| | | | | |
|---|---|---|---|---|
| 1,700,114 A | | 1/1929 | Thompson | |
| 1,957,790 A | | 5/1934 | Mavis et al. | |
| 2,582,470 A | | 1/1952 | Walker et al. | |
| 2,706,368 A | | 4/1955 | Randolph | |
| 4,073,349 A | | 2/1978 | Sumida | |
| 5,464,366 A | * | 11/1995 | Hutchins | 451/356 |
| 5,597,347 A | * | 1/1997 | Bosten et al. | 451/356 |

FOREIGN PATENT DOCUMENTS

| | | |
|---|---|---|
| EP | 0 893 198 B1 | 5/1998 |
| EP | 0893198 | 1/1999 |
| GB | 370269 | 4/1932 |
| JP | 2002-233941 | 2/2001 |

OTHER PUBLICATIONS

Search Report dated Aug. 25, 2006 for International Patent Application No. EP 06252625.6.

* cited by examiner

*Primary Examiner*—Jacob K. Ackun, Jr.
(74) *Attorney, Agent, or Firm*—Howard & Howard Attorneys, P.C.

(57) ABSTRACT

The present invention relates to a dual plate sander comprising a housing, a motor mounted in the housing, first and second transmission devices driven by the motor and eccentric shafts each rotating about a main drive shaft connected to the transmission device. Twin sanding assemblies terminating in sanding plates are mounted on respective eccentric shafts. A guiding element serves to translate the eccentric rotary motion of the eccentric shafts into opposite reciprocating movement of the sanding assemblies. The opposed reciprocating movement serves to balance the inertial forces generated by the sander and reduce oscillations.

16 Claims, 2 Drawing Sheets

DUAL PLATE SANDER

CROSS REFERENCE TO RELATED APPLICATIONS

The subject patent application claims priority to and all the benefits of Chinese Patent Application No. 2005-20108419, which was filed on May 20, 2005 with the Patent Office of the People's Republic of China.

FIELD OF THE INVENTION

The present invention relates to a portable power-operated sander, in particular a dual plate sander.

BACKGROUND OF THE INVENTION

U.S. Pat. No. 4,073,349 discloses a pneumatically operated sander which is driven by a rotary pneumatic motor via an eccentric connection with a gear train. The eccentric connection comprises an eccentric pin and a link. A shoe is driven by the link connected to the eccentric pin. The eccentric pin is connected to the gear train. In order to balance the dynamic forces generated by the sander element, a weight may be properly positioned within the tool housing and driven by a similar eccentric connection to a gear train. Thus the weight is driven reciprocatively in the opposite direction to the shoe. Such a construction has many elements. It is difficult to assemble and is very heavy.

OBJECT OF THE INVENTION

Objects of the present invention are to provide an improved dual plate sander with a simple construction, a relatively compact size and less oscillation.

SUMMARY OF THE INVENTION

In an embodiment the present invention provides a dual plate sander comprising a housing and a motor mounted in the housing. A motor driven first transmission device and second transmission device may be substantially symmetrically disposed oppositely on first (eg posterior) and second (eg anterior) sides of the motor. Each of the first transmission device and second transmission device may comprise a main drive shaft rotationally supported in the housing. Each of the first transmission device and second transmission device may comprise a motor-driven transmission element mounted on the main drive shaft. Each of the first transmission device and second transmission device may comprise an eccentric shaft rotational eccentrically about the main drive shaft. The sander may further comprise a first sanding assembly mounted on the eccentric shaft of the first transmission device which terminates at the base of the housing in a first sanding plate. The sander may further comprise a second sanding assembly mounted on the eccentric shaft of the second transmission device which terminates at the base of the housing in a second sanding plate. The sander may further comprise a guiding element secured to the housing and adapted to guide the driven first sanding assembly and second sanding assembly reciprocatively in opposite directions.

Viewed from a first aspect the present invention provides a dual plate sander comprising:

a housing;

a motor mounted in the housing;

a first transmission device and a second transmission device substantially symmetrically disposed oppositely on first (eg posterior) and second (eg anterior) sides of the motor and driven by the motor, wherein each of the first transmission device and second transmission device comprises:

a main drive shaft rotationally supported in the housing, a motor-driven transmission element mounted on the main drive shaft and an eccentric shaft rotational eccentrically about the main drive shaft;

a first sanding assembly mounted on the eccentric shaft of the first transmission device and terminating at the base of the housing in a first sanding plate;

a second sanding assembly mounted on the eccentric shaft of the second transmission device and terminating at the base of the housing in a second sanding plate; and a guiding element secured to the housing and adapted to guide the driven first sanding assembly and second sanding assembly reciprocatively in opposite directions.

By deploying eccentric shafts instead of eccentric pins and links, the present invention advantageously constitutes a relatively compact sander.

The first and second sanding plate may be generally shoe-like. The base of the first and second sanding plates are substantially coplanar.

In a preferred embodiment, the first sanding assembly and the second sanding assembly are driven non-orbitally (preferably linearly reciprocatively) in opposite directions.

In a preferred embodiment, the first sanding assembly and the second sanding assembly each comprise:

a sanding link operatively connected to the eccentric shaft and to the sanding plate. Particularly preferably each sanding assembly further comprises:

a rotary bearing mounted radially on the eccentric shaft; and an elastic buffer member mounted radially on the rotary bearing, the rotary bearing being seated in the sanding link.

Preferably in use the rotary bearing moves relative to the buffer member.

Preferably the guiding element comprises two guide slots and the sanding links are movably confined partially within the guide slots. Particularly preferably each guide slot is defined by a pair of substantially parallel guiding walls extending downwardly.

In a preferred embodiment, the guiding element comprises an elastic member, wherein a first end of the elastic member is connected to the housing and a second end of the elastic member is connected to the sanding plate.

In a preferred embodiment, the transmission element is a transmission gear. The sander may further comprise a pinion gear mounted radially on an output shaft of the motor. The pinion gear and transmission elements (eg gears) may be substantially coplanar.

Preferably the main drive shaft and the eccentric shaft are a unitary (eg monolithic) body and the main drive shaft extends downwardly into the eccentric shaft.

Preferably the transmission element of each transmission device in use rotates in the same direction. Particularly preferably the eccentric shafts of the first and second transmission devices are in opposite diametrical orientations with respect to the main drive shaft whereby the eccentric shafts rotate out of phase substantially by 180 degrees.

In a preferred embodiment, the guiding element comprises:

a guiding plate with a posterior aperture and an anterior aperture which receive respectively the eccentric shafts of the first and second transmission device, wherein from the periphery of each of the first and second apertures extends a pair of substantially parallel guiding lips each defining a substantially linear guide slot.

Particularly preferably each of the first and second sanding assemblies comprises:

a rotary bearing mounted radially on the eccentric shaft;

a buffer member mounted radially on the rotary bearing; and a sanding link with an upper cradle part confined partially in the guide slot and a lower part connected to the sanding plate, wherein the buffer member and the rotary bearing are seated in the upper cradle part.

Preferably the buffer member is elastic or resilinet. The buffer members may reduce rigid collision between the rotary bearing and the sanding link. This may reduce noise and increase longevity of the sander.

Preferably each rotary bearing in use is alternately and oppositely driven into contact with a lateral face of the buffer member and a medial face of the buffer member whereby to drive the sanding link to and fro guided by the guide slot.

The motor may be electrically driven or pneumatically driven. Preferably the motor is electrically driven.

Preferably the guiding member comprises guiding walls and a guiding plate. The guiding plate may be monolithic with the guiding walls or the guiding walls may be mounted on the guiding plate.

Preferably the transmission elements are gears.

DETAILED DESCRIPTION OF THE PREFERRED EMBODIMENTS

Figure 1:
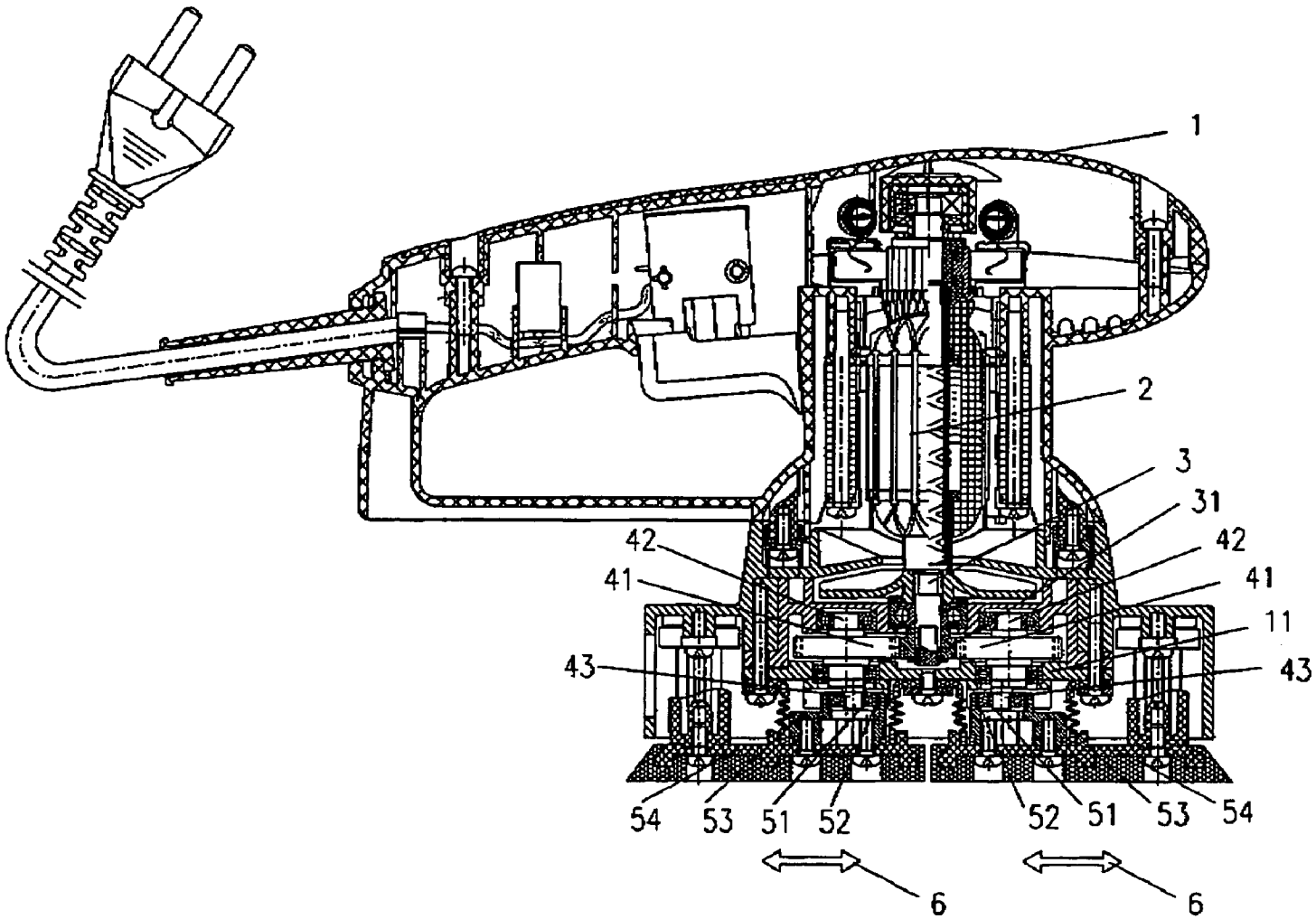
FIG. 1 shows a cross-section view of a preferred embodiment of the present invention.
Figure 2:
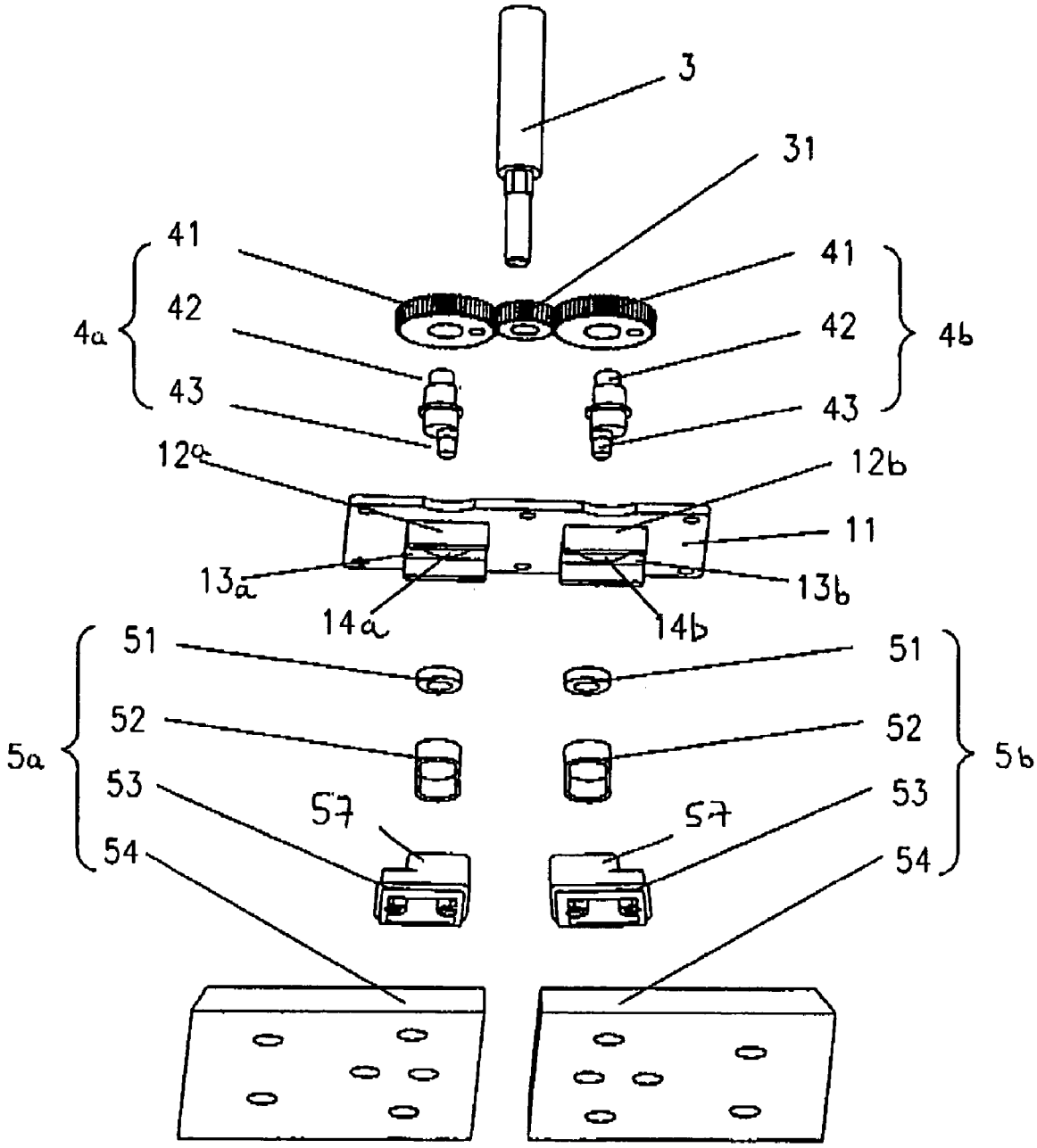
FIG. 2 shows a part exploded view of the preferred embodiment of the present invention.

As shown in FIGS. 1 and 2, an embodiment of a dual plate sander of the present invention comprises a housing 1, an electrically driven rotary motor 2 having an output shaft 3 mounted in an upper part of the housing 1 and a first and second transmission device 4*a,b* driven by the motor 2. The first and second transmission devices 4*a,b* are symmetrically disposed oppositely on posterior and anterior sides of the motor 2. Each transmission device 4*a,b* comprises a transmission gear 41 mounted on a main drive shaft 42 which is rotationally supported axially in parallel to the output shaft 3. The transmission gear 41 engages a pinion gear 31 which is fixed on the output shaft 3. The main drive shaft 42 extends downwardly into an eccentric shaft portion 43 of a smaller diameter. The transmission gear 41 of each transmission device 4*a,b* rotates in the same direction. However the eccentric shaft portions 43 are in opposite diametrical orientations with respect to the main drive shaft 42. This means that as the transmission gears 41 turn, the eccentric shaft portions 43 rotate out of phase by 180 degrees.

First and second sanding assembly 5*a,b* at the base of the housing 1 are operatively connected to the first and second transmission devices 4*a,b* respectively. A guiding element 11 is secured to the housing 1 between the transmission devices 4*a,b* and the sanding assemblies 5*a,b*. The guiding element 11 comprises a guiding plate 15 with a posterior aperture 14*a* and an anterior aperture 14*b* which receive respectively the eccentric shaft portions 43. From the periphery of each of the posterior and anterior apertures 14*a,b* extends perpendicularly downwardly a pair of substantially parallel guiding lips 12*a,b* which are unitary with the plate and define a pair of substantially linear guide slots 13*a,b*. The guiding element 11 serves to translate the eccentric rotary motion of each eccentric shaft 43 into reciprocating movement of the sanding assemblies 5*a,b* as described below.

Each of the first and second sanding assemblies 5*a,b* comprises a rotary bearing 51 mounted radially on the eccentric shaft portion 43 and an elastic buffer member 52 loosely mounted radially on the rotary bearing 51. A sanding link 53 comprises an upper cradle part 57 confined partially in the guide slot 13*a,b* and a lower part connected to the sanding plate 5. The buffer member 52 and the rotary bearing 51 are seated in the upper cradle part 57.

Each rotary bearing 51 in use is alternately and oppositely driven into contact with a lateral face of the buffer member 52 and a medial face of the buffer member 52. This drives the sanding link 53 to and fro guided by the guide slot 13*a,b* and causes reciprocating motion of the sanding assembly 5*a,b*. The sanding plates 54 reciprocate in opposite directions (as shown by arrows 6 in FIG. 1) due to the respective orientation of each eccentric shaft 43 causing motion 180 degrees out of phase. The opposite reciprocating movement of each sanding assembly 5*a,b* balances the net force generated by the sander and reduces vibrations.

I claim:

1. A dual plate sander comprising:

a housing;

a motor mounted in the housing;

a first transmission device and a second transmission device substantially symmetrically disposed oppositely on first and second sides of the motor and driven by the motor, wherein each of the first transmission device and second transmission device comprises:

a main drive shaft rotationally supported in the housing, a motor-driven transmission element mounted on the main drive shaft and an eccentric shaft rotational eccentrically about the main drive shaft;

a first sanding assembly mounted on the eccentric shaft of the first transmission device and terminating at the base of the housing in a first sanding plate;

a second sanding assembly mounted on the eccentric shaft of the second transmission device and terminating at the base of the housing in a second sanding plate; and a guiding element secured to the housing and adapted to guide the driven first sanding assembly and second sanding assembly reciprocatively in opposite directions.

2. The dual plate sander according to claim 1 wherein the first sanding assembly and the second sanding assembly are driven linearly reciprocatively in opposite directions.

3. The dual plate sander according to claim 1 wherein the first sanding assembly and the second sanding assembly each comprise:

a sanding link operatively connected to the eccentric shaft and to the sanding plate.

4. The dual plate sander according to claim 3, wherein each sanding assembly further comprises:

a rotary bearing mounted radially on the eccentric shaft; and an elastic buffer member mounted radially on the rotary bearing, the rotary bearing being seated in the sanding link.

5. The dual plate sander according to claim 4 wherein in use the rotary bearing moves relative to the buffer member.

6. The dual plate sander according to claim 3, wherein the guiding element comprises two guide slots and the sanding links are movably confined partially within the guide slots.

7. The dual plate sander according to claim 6, wherein each guide slot is defined by a pair of substantially parallel guiding walls extending downwardly.

8. The dual plate sander according to claim 1, wherein the guiding element comprises an elastic member, wherein a first end of the elastic member is connected to the housing and a second end of the elastic member is connected to the sanding plate.

9. The dual plate sander according to claim 1, wherein the transmission element is a gear.

10. The dual plate sander according to claim 1 wherein the main drive shaft and the eccentric shaft are a unitary body and the main drive shaft extends downwardly into the eccentric shaft.

11. The dual plate sander according to claim 1 wherein the transmission element of each transmission device in use rotates in the same direction.

12. The dual plate sander according to claim 11, wherein the eccentric shafts of the first and second transmission devices are in opposite diametrical orientations with respect to the main drive shaft whereby the eccentric shafts rotate out of phase substantially by 180 degrees.

13. The dual plate sander according to claim 1, wherein the guiding element comprises:

a guiding plate with a posterior aperture and an anterior aperture which receive respectively the eccentric shafts of the first and second transmission device, wherein from the periphery of each of the first and second apertures extends a pair of substantially parallel guiding lips each defining a substantially linear guide slot.

14. The dual plate sander according to claim 13, wherein each of the first and second sanding assemblies comprises:

a rotary bearing mounted radially on the eccentric shaft;

a buffer member mounted radially on the rotary bearing; and a sanding link with an upper cradle part confined partially in the guide slot and a lower part connected to the sanding plate, wherein the buffer member and the rotary bearing are seated in the upper cradle part.

15. The dual plate sander according to claim 14, wherein each rotary bearing in use is alternately and oppositely driven into contact with a lateral face of the buffer member and a medial face of the buffer member whereby to drive the sanding link to and fro guided by the guide slot.

16. A dual plate sander according to claim 1 wherein the first transmission device and the second transmission device are substantially symmetrically disposed oppositely on posterior and anterior sides of the motor.

* * * * *